US008139079B2

(12) United States Patent
Ueyama

(10) Patent No.: US 8,139,079 B2
(45) Date of Patent: Mar. 20, 2012

(54) COLOR GAMUT COMPONENT ANALYSIS APPARATUS, METHOD OF ANALYZING COLOR GAMUT COMPONENT, AND COLOR GAMUT COMPONENT ANALYSIS PROGRAM

(75) Inventor: Akihiro Ueyama, Tokyo (JP)

(73) Assignee: Sony Corporation, Tokyo (JP)

( * ) Notice: Subject to any disclaimer, the term of this patent is extended or adjusted under 35 U.S.C. 154(b) by 662 days.

(21) Appl. No.: 12/123,212

(22) Filed: May 19, 2008

(65) Prior Publication Data

US 2008/0297531 A1 Dec. 4, 2008

(30) Foreign Application Priority Data

Jun. 4, 2007 (JP) ..... 2007-148202

(51) Int. Cl.
*G09G 5/02* (2006.01)

(52) U.S. Cl. ..... 345/590; 345/589; 345/591; 345/594; 345/595; 345/440; 345/440.1; 345/440.2; 382/168; 382/170; 715/215; 348/234

(58) Field of Classification Search ..... None
See application file for complete search history.

(56) References Cited

U.S. PATENT DOCUMENTS 7,289,663 B2 * 10/2007 Spaulding et al. ..... 382/167

FOREIGN PATENT DOCUMENTS

| | | | |
|---|---|---|---|
| JP | 2004208028 | * | 7/2004 |
| JP | 2006-33575 | | 2/2006 |
| JP | 2007-28478 | | 2/2007 |
| JP | 2007-286120 | | 11/2007 |

* cited by examiner

*Primary Examiner* — Antonio A Caschera
(74) *Attorney, Agent, or Firm* — Oblon, Spivak, McClelland, Maier & Neustadt, L.L.P.

(57) ABSTRACT

A color gamut component analysis apparatus having a histogram processing unit that performs histogram processing on color components in a video signal; a color gamut component calculating section that calculates a wide color gamut component larger than a signal by a predetermined standard from the result of the histogram processing by the histogram processing unit; and a graphic processing section that generates and outputs a user interface image which shows the presence of the wide color gamut component in the video signal or the ratio of the wide color gamut component to the video signal.

11 Claims, 10 Drawing Sheets

FG8

G4

G5

COLOR GAMUT COMPONENT ANALYSIS APPARATUS, METHOD OF ANALYZING COLOR GAMUT COMPONENT, AND COLOR GAMUT COMPONENT ANALYSIS PROGRAM

CROSS REFERENCES TO RELATED APPLICATIONS

The present invention contains subject matter related to Japanese Patent Application JP2007-148202 filed in the Japanese Patent Office on Jun. 4, 2007, the entire contents of which being incorporated herein by reference.

BACKGROUND OF THE INVENTION

1. Field of the Invention

The present invention relates to a color gamut component analysis apparatus, a method of analyzing a color gamut component, and a color gamut component analysis program, and is suitably applied to a display device such as a handy type video camera and a liquid crystal television, for example.

2. Description of the Related Art

In a display device, a displayable color area became wide, and a device that copes with a color space standard for motion picture called "xvYCC" by that a color in a larger area than a color space prescribed by the standard RGB (sRGB standard) in the International Electrotechnical Commission (IEC), and a color space prescribed by the National Television System Committee (NTSC) standard can be reproduced have been developed. Colors which could not be represented by a conventional device can also be displayed.

Further, there is a video camera capable of providing a signal that can represent a color of a wider color gamut than a predetermined standard, and can be dealt with an apparatus conformed to a predetermined standard (see Jpn. Pat. Appln. Laid-Open Publication No.: 2006-33575, for example).

SUMMARY OF THE INVENTION

A display device having the above configuration copes with the color space standard for motion picture called "xvYCC" that can reproduce a color in a larger area than the conventional color spaces by the sRGB standard and the NTSC standard. However, if a wide color gamut component does not exist in a video signal itself that is supplied to the above display device, also as to a display image based on the video signal, any difference from conventional display images by the sRGB standard and the NTSC standard is not found.

Further, even if a wide color gamut component existed in a video signal itself, that a wide color gamut component by the xvYCC standard was included in comparison to conventional color gamut components by the sRGB standard and the NTSC standard has not been visually shown to the user. There has been a problem that the user cannot clearly recognize whether or not a wide color gamut component is included in the video signal.

The present invention has been done considering the above points and is proposing a color gamut component analysis apparatus, a method of analyzing a color gamut component, and a color gamut component analysis program that can make the user visually recognize the presence of a wide color gamut component and the ratio as easy to understand.

To obviate such problems according to the present invention, histogram processing is performed on color components in a video signal, a wide color gamut component larger than a signal by a predetermined standard is calculated from the result of the histogram processing, and a user interface image that shows the presence of the wide color gamut component in the video signal, or the ratio of the wide color gamut component to the video signal is generated and outputted. It can make the user visually and immediately recognize the presence of the wide color gamut component larger than the signal by the predetermined standard or the ratio.

According to the present invention, histogram processing is performed on color components in a video signal, a wide color gamut component larger than a signal by a predetermined standard is calculated from the result of the histogram processing, and a user interface image that shows the presence of the wide color gamut component in the video signal, or the ratio of the wide color gamut component to the video signal is generated and outputted. It can make the user visually and immediately recognize the presence of the wide color gamut component larger than the signal by the predetermined standard or the ratio. Thus, a color gamut component analysis apparatus, a method of analyzing a color gamut component, and a color gamut component analysis program that can make the user visually recognize the presence of a wide color gamut component and the ratio as easy to understand can be realized.

The nature, principle and utility of the invention will become more apparent from the following detailed description when read in conjunction with the accompanying drawings in which like parts are designated by like reference numerals or characters.

DETAILED DESCRIPTION OF PREFERRED EMBODIMENTS

An embodiment of the present invention will be described in detail with reference to the accompanying drawings.

(1) Chromaticity Distribution by Each Signal Standard

Figure 1:
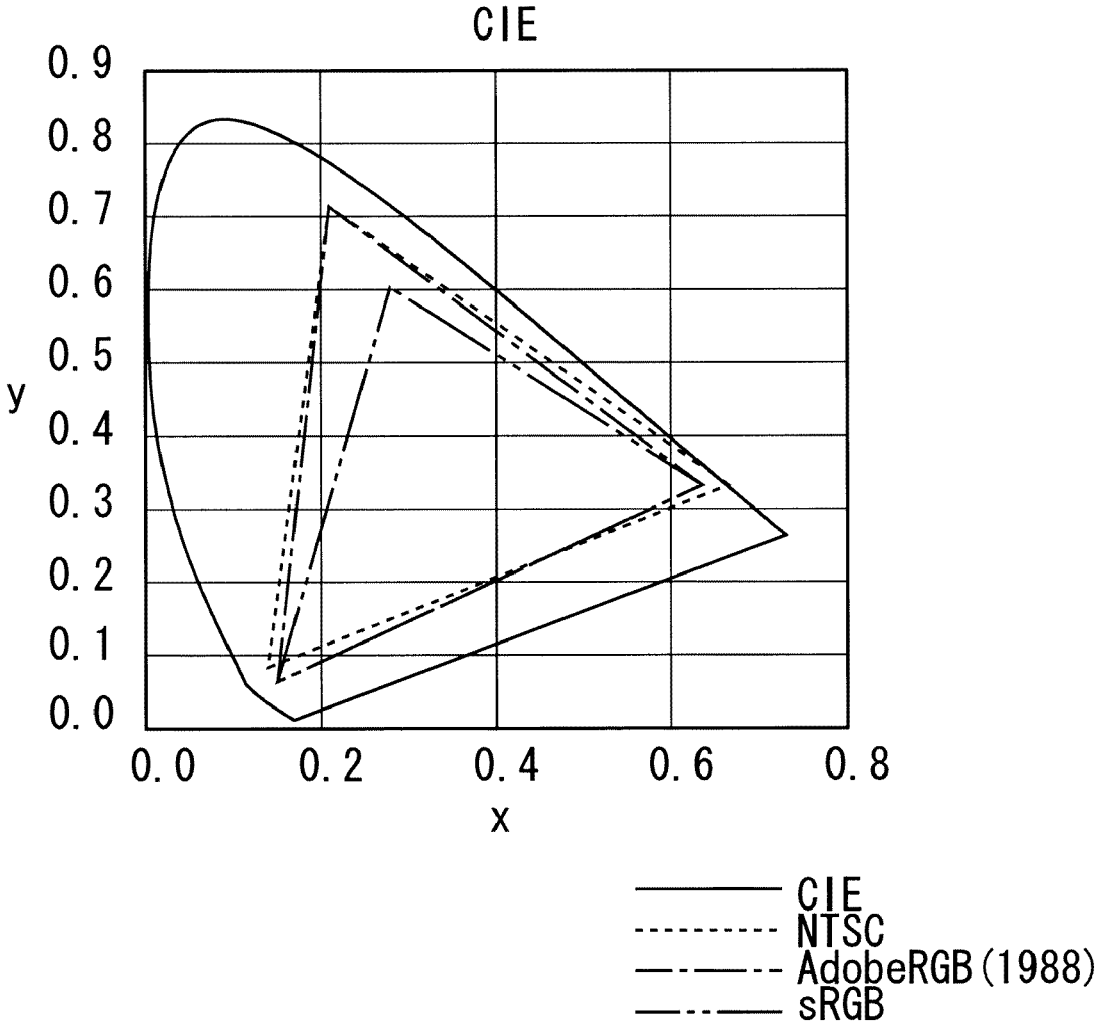
FIG. 1 is a schematic diagram showing chromaticity distribution.

In FIG. 1, a difference in color areas according to standards of a video signal is shown. They are a chromaticity distribution in the Comission Internationale de I'Eclariage (CIE)

color system, a chromaticity distribution by the NTSC standard, a chromaticity distribution by the AdobeRGB (1988) standard, and a chromaticity distribution by the sRGB standard, of a standard white.

In the sRGB standard that has been the mainstream of a conventional video signal, the color area of a Cathode Ray Tube (CRT) is considered, and it is considerably narrower than the NTSC standard. In recent years, an Liquid Crystal Display (LCD) display device, a printer or the like that have the material characteristic of a large color area have been commercialized. In accompanying with this, as a new signal standard, the AdobeRGB (1988), xvYCC and the like have been proposed.

The xvYCC being the color space standard of a large color area in motion images is an international standard of a motion image color space capable of representing colors extremely close to human eyes that is approximately 1.8 times to the color space standard used in the going broadcast or the like in the "Munsell color cascade" chart. It is defined as a part exceeding the chromaticity distribution by the sRGB standard.

For example, in the NTSC standard, that the color area is extended to much wider range than the sRGB standard, and the wide color gamut component is expanded is shown. However, even if a video signal in the color area by the sRGB standard would be reproduced faithfully to the NTSC standard, it is difficult to distinguish the video signal by the sRGB standard from the video signal by the NTSC standard.

Then, according to the present invention, for example, in the video signal by the xvYCC standard, a wider color gamut signal component larger than the color area of the sRGB standard (hereinafter, this is referred to as wide color gamut component) is calculated, and the presence of the wide color gamut component and the ratio are displayed on a display screen, in order to make the user readily recognize the presence of the wide color gamut component.

(2) Configuration of Color Gamut Component Analysis Apparatus

Figure 2:
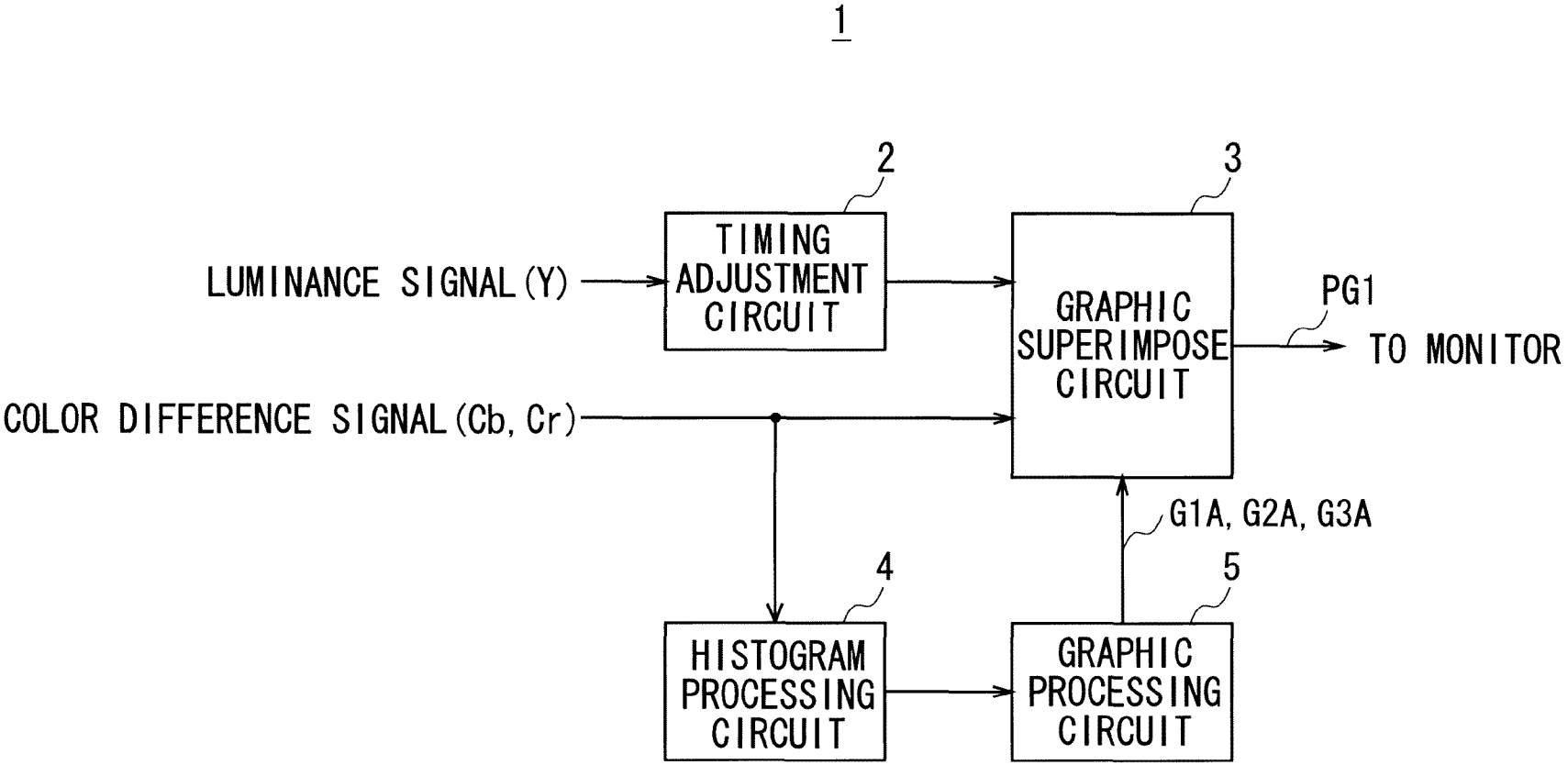
FIG. 2 is a schematic block diagram showing the configuration of a color gamut component analysis apparatus.

Referring to FIG. 2, the reference numeral 1 generally shows a color gamut component analysis apparatus being the center of the present invention. A luminance signal (Y) forming the video signal by the xvYCC standard is transmitted to a timing adjustment circuit 2, and a color difference signal (Cb, Cr) is transmitted to a graphic superimpose circuit 3 and a histogram processing circuit 4.

The histogram processing circuit 4 performs histogram processing based on the color difference signal (Cb, Cr). In the case where the total sum sRGBmax of a color gamut component amount in the sRGB standard is set to a threshold level, and a wide color gamut component amount WC above this threshold level is represented using the total sum MAX of a color gamut component amount in the xvYCC standard, the wide color gamut component amount WC is calculated, for example, based on the following equation:

$$WC(\%)=\{(\mathrm{MAX}-sRGB\mathrm{max})/\mathrm{MAX}\}\times 100 \quad (1)$$

The calculation result is transmitted to a graphic processing circuit 5.

The graphic processing circuit 5 performs graphic processing for visually displaying the wide color gamut component amount WC above the total sum sRGBmax of the color gamut component amount in the sRGB standard as easy to understand, based on the calculation result supplied from the histogram processing circuit 4, and for example to graph it, and transmits the graphic processed image to the graphic superimpose circuit 3.

Figure 3A:
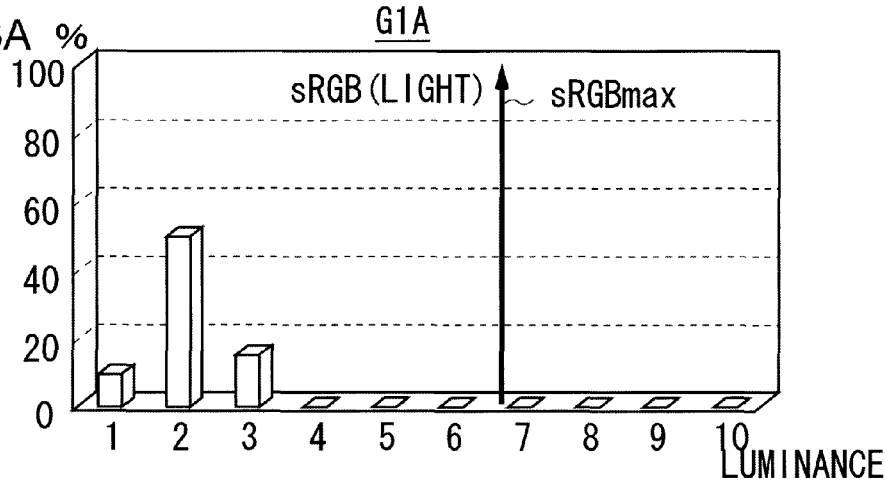
FIGS. 3A-3C are schematic diagrams showing a graphic processing image representing a color component.
Figure 3B:
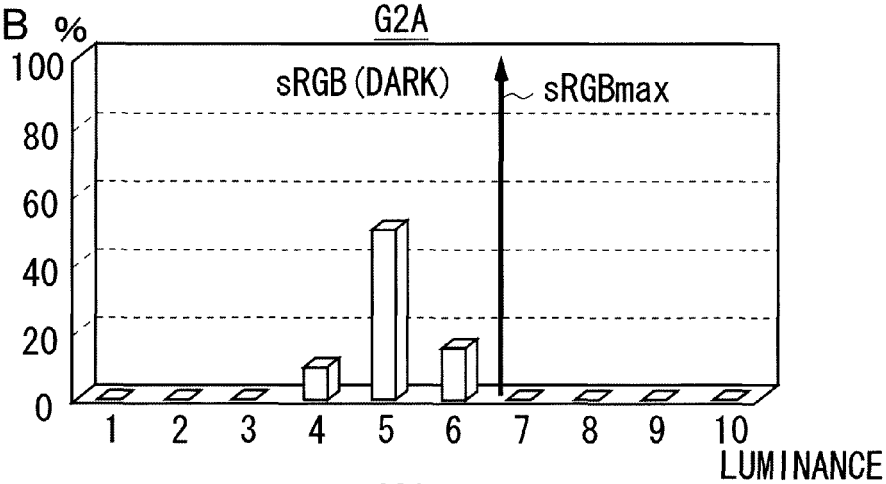
Figure 3C:
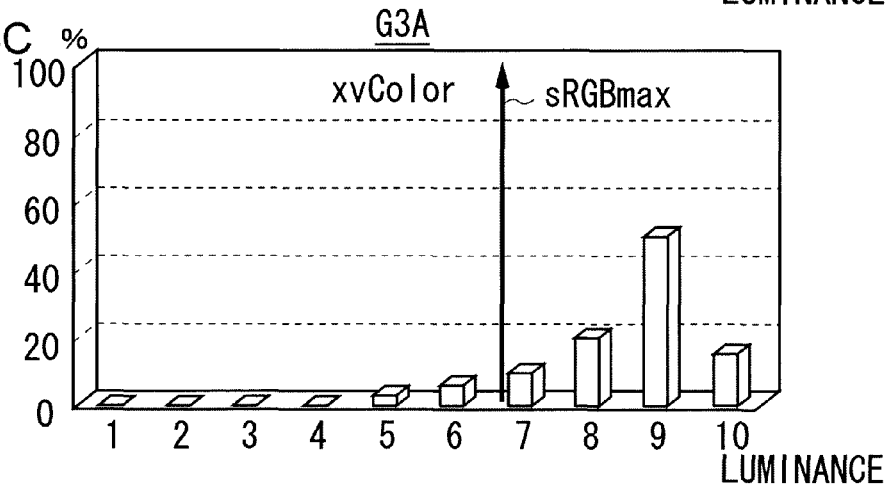

In this case, only if there is a part above the chromaticity distribution of the sRGB standard in any one of R (Red), G (Green) and B (Blue), the graphic processing circuit 5 generates a graphed graphic processed image G1A, G2A or G3A, for example, shown in FIG. 3A, 3B or 3C, by using the calculation result of the wide color gamut component amount WC concerning the color (green, for example).

In the graphic processed image G1A in FIG. 3A, being an image in a light color (green) by the SRGB standard in that chromaticity distribution in the video signal is vastly lower than the threshold level shown by the total sum sRGBmax of the color gamut component amount in the sRGB standard is shown.

In the graphic processed image G2A in FIG. 3B, being an image in a dark color (green) by the sRGB standard in that chromaticity distribution in the video signal is slightly lower than the threshold level shown by the total sum sRGBmax of the color gamut component amount in the sRGB standard is shown.

Further, in the graphic processed image G3A in FIG. 3C, being an image in a quite deep color (green) by the xvYCC standard in that most part of chromaticity distribution in the video signal is higher than the threshold level shown by the total sum sRGBmax of the color gamut component amount in the sRGB standard is shown.

Note that, all of the graphic processed images G1A-G3A are represented by making chromaticity to all pixels in an image for one frame correspond to ten luminance levels.

By the way, the timing adjustment circuit 2 holds a luminance signal (Y) for the processing time in the aforementioned histogram processing circuit 4 and graphic processing circuit 5, and transmits the above luminance signal (Y) to the graphic superimpose circuit 3 at the same timing as that the graphic processed image G1A, G2A or G3A is supplied from the graphic processing circuit 5 to the graphic superimpose circuit 3.

The graphic superimpose circuit 3 generates a reproducing image based on the luminance signal (Y) supplied from the timing adjustment circuit 2, and the color difference signal (Cb, Cr), and superimposes the graphic processed image G1A, G2A or G3A supplied from the graphic processing circuit 5 on the reproducing image to generate a graphic superimposed video signal PG1, and outputs this from a monitor in the latter stage as a graphic superimposed image.

Figure 4:
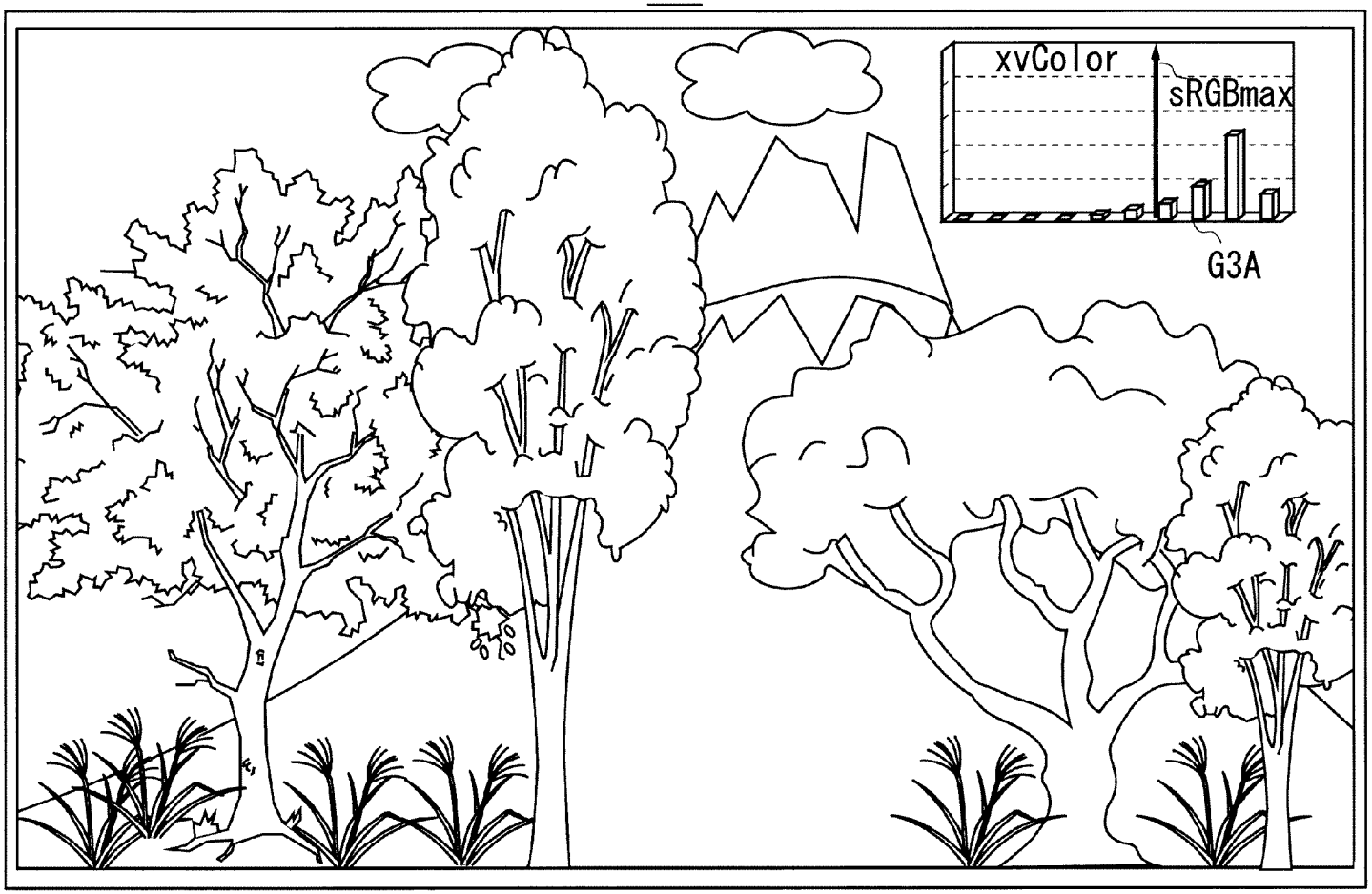
FIG. 4 is a schematic diagram showing an example of a graphic superimposed image.

In this case, for example, as shown in FIG. 4, the color gamut component analysis apparatus 1 displays a graphic superimposed video image FG in that the graphic processed image G3A was superimposed in the reproducing image on the monitor, based on the graphic superimposed video signal PG1. It can make the user who is visually confirming the reproducing image of the above graphic superimposed video image FG recognize that a green component such as a mountain and a forest in the reproducing image is represented by a quite deep color (green) by the xvYCC standard via the graphic processed image G3A.

Figure 5:
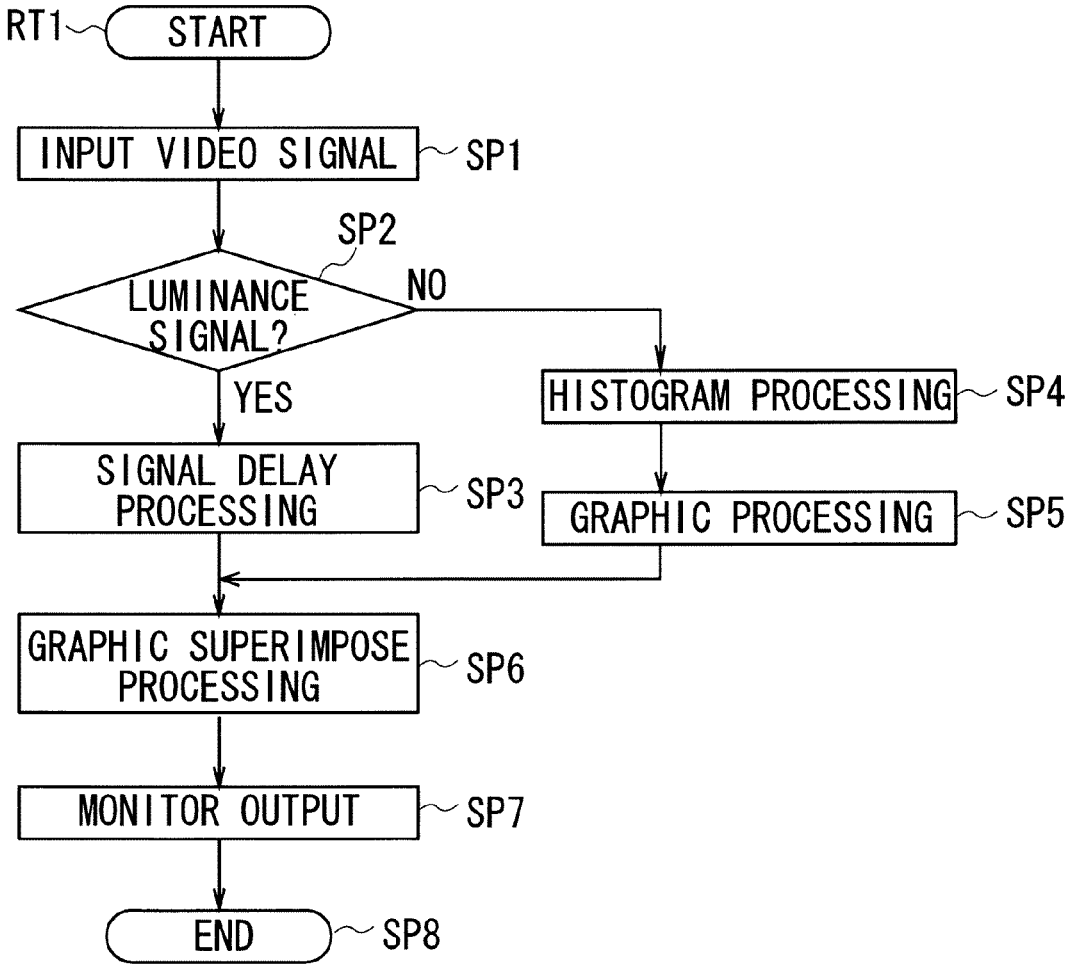
FIG. 5 is a flowchart showing a processing procedure for displaying a wide color gamut component.

(3) Processing Procedure for Displaying Wide Color Gamut Component by Color Gamut Component Analysis Apparatus As shown in FIG. 5, the color gamut component analysis apparatus 1 enters the processing from the start step of a routine RT1 according to a color gamut component analysis program, and proceeds to the next step SP1 to input a video signal composed of a luminance signal (Y) and a color difference signal (Cb, Cr), and proceeds to the next step SP2.

In step SP2, the color gamut component analysis apparatus 1 distinguishes whether or not the video signal is a luminance signal (Y). An affirmative result is obtained on the luminance signal (Y), and the color gamut component analysis apparatus 1 proceeds to the next step SP3.

In step SP3, the color gamut component analysis apparatus 1 transmits the luminance signal (Y) to the timing adjustment circuit 2 to perform signal delay processing for holding it for the time necessary for the histogram processing circuit 4 and the graphic processing circuit 5, and then transmits the delayed signal to the graphic superimpose circuit 3, and proceeds to the next step SP6.

On the contrary, if the video signal is not a luminance signal (Y) but a color difference signal (Cb, Cr) in step SP2, a negative result is obtained. The color gamut component analysis apparatus 1 transmits the color difference signal (Cb, Cr) to the graphic superimpose circuit 3, and also transmits this to the histogram processing circuit 4, and proceeds to the next step SP4.

In step SP4, the color gamut component analysis apparatus 1 makes the histogram processing circuit 4 perform histogram processing based on the color difference signal (Cb, Cr), and calculates a wide color gamut component amount WC above the total sum sRGBmax of a color gamut component amount in the sRGB standard by the aforementioned equation (1). The color gamut component analysis apparatus 1 transmits the calculation result to the graphic processing circuit 5, and proceeds to the next step SP5.

In step SP5, the color gamut component analysis apparatus 1 generates a graphic processed image G1A, G2A or G3A by performing graphic processing for visually displaying the wide color gamut component amount WC above the total sum sRGBmax of the color gamut component amount in the sRGB standard as easy to understand, based on the calculation result supplied from the histogram processing circuit 4 by means of the graphic processing circuit 5. The color gamut component analysis apparatus 1 transmits it to the graphic superimpose circuit 3, and proceeds to the next step SP6.

In step SP6, by means of the graphic superimpose circuit 3, the color gamut component analysis apparatus 1 generates a reproducing image based on the luminance signal (Y) supplied from the timing adjustment circuit 2 and the color difference signal (Cb, Cr), and superimposes the graphic processed image G1A, G2A or G3A supplied from the graphic processing circuit 5 on the reproducing image and generates a graphic superimposed video signal PG1, and proceeds to the next step SP7.

In step SP7, the color gamut component analysis apparatus 1 outputs the graphic superimposed video signal PG1 generated by the graphic superimpose circuit 3 to the monitor and displays a graphic superimposed image, and proceeds to the next step SP8 to finish the processing.

(4) Mounting Example of Color Gamut Component Analysis Apparatus

Next, the concrete configuration of a liquid crystal television and a handy type video camera that mount a graphic generation circuit corresponding to such color gamut component analysis apparatus 1 will be described.

(4-1) Configuration of Liquid Crystal Television

Figure 6:
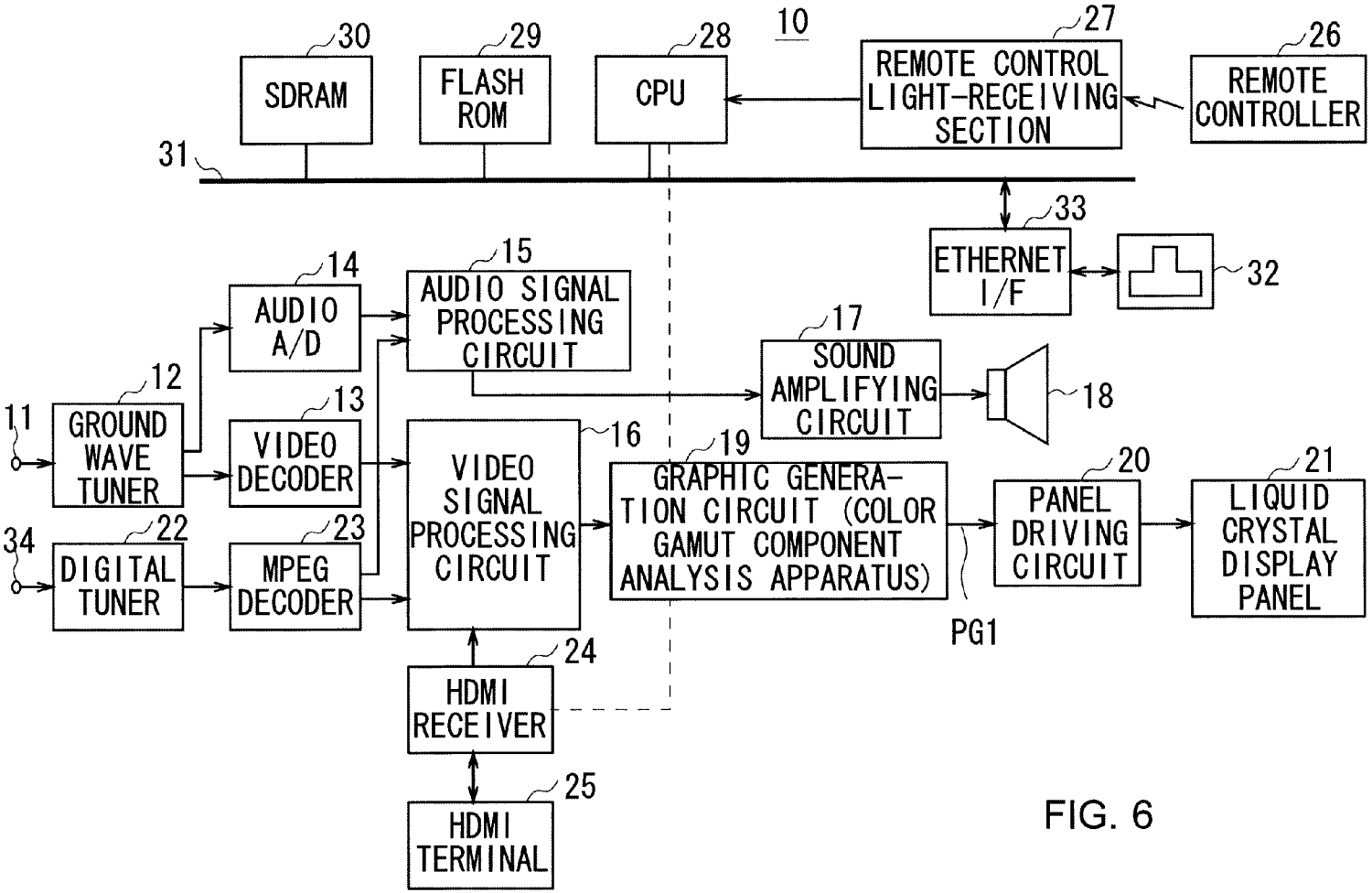
FIG. 6 is a schematic block diagram showing the circuit configuration of a liquid crystal television.

Referring to FIG. 6, the reference numeral 10 generally shows a liquid crystal television mounting a graphic generation circuit that corresponds to the color gamut component analysis apparatus 1. A Central Processing Unit (CPU) 28 integrally controls the whole apparatus, and executes predetermined processing by starting a basic program and various application programs (including a color gamut component analysis program) stored in a flash ROM 29 that is connected via an internal bus 31 in a Synchronous Dynamic Random Access Memory (SDRAM) 30.

Practically, the liquid crystal television 10 receives a command from the user that was received from a remote controller (hereinafter, this is referred to as "remocon") by a remote control light-receiving section 27, and transmits it to the CPU 28.

The CPU 28 of the liquid crystal television 10 supplies a broadcast wave signal entered from an antenna input terminal 11 for receiving ground analog broadcast to a ground wave tuner 12 according to the command. The CPU 28 demodulates it into a video signal and an audio signal in a baseband by the above ground wave tuner 12, and transmits the audio signal to an audio analog-to-digital (A/D) converting circuit 14 and transmits the video signal to a video decoder 13.

The audio A/D converting circuit 14 performs analog-to-digital conversion on the audio signal to generate digital audio data, and transmits this to an audio signal processing circuit 15. The audio signal processing circuit 15 performs predetermined signal processing on the digital audio data, and then transmits the audio data to an audio amplifying circuit 17. The audio amplifying circuit 17 performs digital-to-analog conversion on the digital audio data, and then amplifies this to a predetermined level, and outputs thus obtained audio signal from a speaker 18 as television sound.

On the other hand, a video decoder 13 converts the video signal in the baseband into a digital component signal composed of a luminance signal (Y) and a color difference signal (Cb, Cr), and transmits the digital component signal to a video signal processing circuit 16. The video signal processing circuit 16 performs predetermined signal processing on the digital component signal, and then transmits the digital component signal to a graphic generation circuit 19.

The graphic generation circuit 19 corresponds to the aforementioned color gamut component analysis apparatus 1 (FIG. 2). The graphic generation circuit 19 transmits a graphic superimposed video signal PG1 that was obtained by superimposing a graphic processed image G1A, G2A or G3A on a reproducing image to a panel driving circuit 20.

The panel driving circuit 20 drives a liquid crystal display panel 21 according to the graphic superimposed video signal PG1 supplied from the graphic generation circuit 19, so that a graphic superimposed image based on the graphic superimposed video signal PG1 is displayed on the above liquid crystal display panel 21.

Further, the CPU 28 of the liquid crystal television apparatus 10 inputs a broadcast wave signal entered from an antenna input terminal 34 for receiving digital broadcast to a digital tuner for demodulation 22, according to a command from the user that was received from the remote controller 26 via the remote control light-receiving section 27. The CPU 28 converts the signal into a Moving Picture Experts Group-Transport Stream (MPEG-TS) by the above digital tuner for demodulation 22, and transmits it to an MPEG decoder 23.

The MPEG decoder 23 decodes the MPEG-TS stream to convert the signal into a digital component signal and digital audio data, and transmits the digital audio data to the audio signal processing circuit 15, and transmits the digital component signal to the video signal processing circuit 16.

The video signal processing circuit 16 performs predetermined signal processing on the digital component signal, and then transmits the digital component signal to the graphic generation circuit 19. The graphic generation circuit 19 transmits the graphic superimposed video signal PG1 that was obtained by superimposing the graphic processed image G1A, G2A or G3A on the reproducing image to the panel driving circuit 20.

The panel driving circuit 20 drives the liquid crystal display panel 21 according to the graphic superimposed video signal PG1 supplied from the graphic generation circuit 19, so that a graphic superimposed image based on the graphic superimposed video signal PG1 is displayed on the above liquid crystal display panel 21.

Note that, the CPU 28 of the liquid crystal television apparatus 10 has a High-Definition Multimedia Interface (HDMI) terminal 25. Thereby, a digital component signal supplied from the outside via the above HDMI terminal 25 can be received by an HDMI receiver 24, and it can be taken in the video signal processing circuit 16.

Therefore, in the liquid crystal television apparatus 10, predetermined processing can be also performed on the digital component signal taken in from the outside via the HDMI terminal 25. The graphic processed image G1A, G2A or G3A can be generated by the graphic generation circuit 19, and the graphic superimposed video signal PG1 can be generated by superimposing it on the reproducing image, and this can be displayed on the liquid crystal display panel 21 by the panel driving circuit 20 as a graphic superimposed image.

In this connection, the liquid crystal television apparatus 10 can be externally connected to the Internet or the like via a network terminal 32 and an Ethernet (registered trademark) interface (I/F) 33. Predetermined signal processing can be also performed on a digital component signal taken in from the outside via the Internet. A graphic processed image G1A, G2A or G3A is generated via the graphic generation circuit 19. It is superimposed on a reproducing image, to generate a graphic superimposed video signal PG1, and this can be displayed on the liquid crystal display panel 21 via the panel driving circuit 20 as a graphic superimposed image.

(4-2) Configuration of Video Camera

Figure 7:
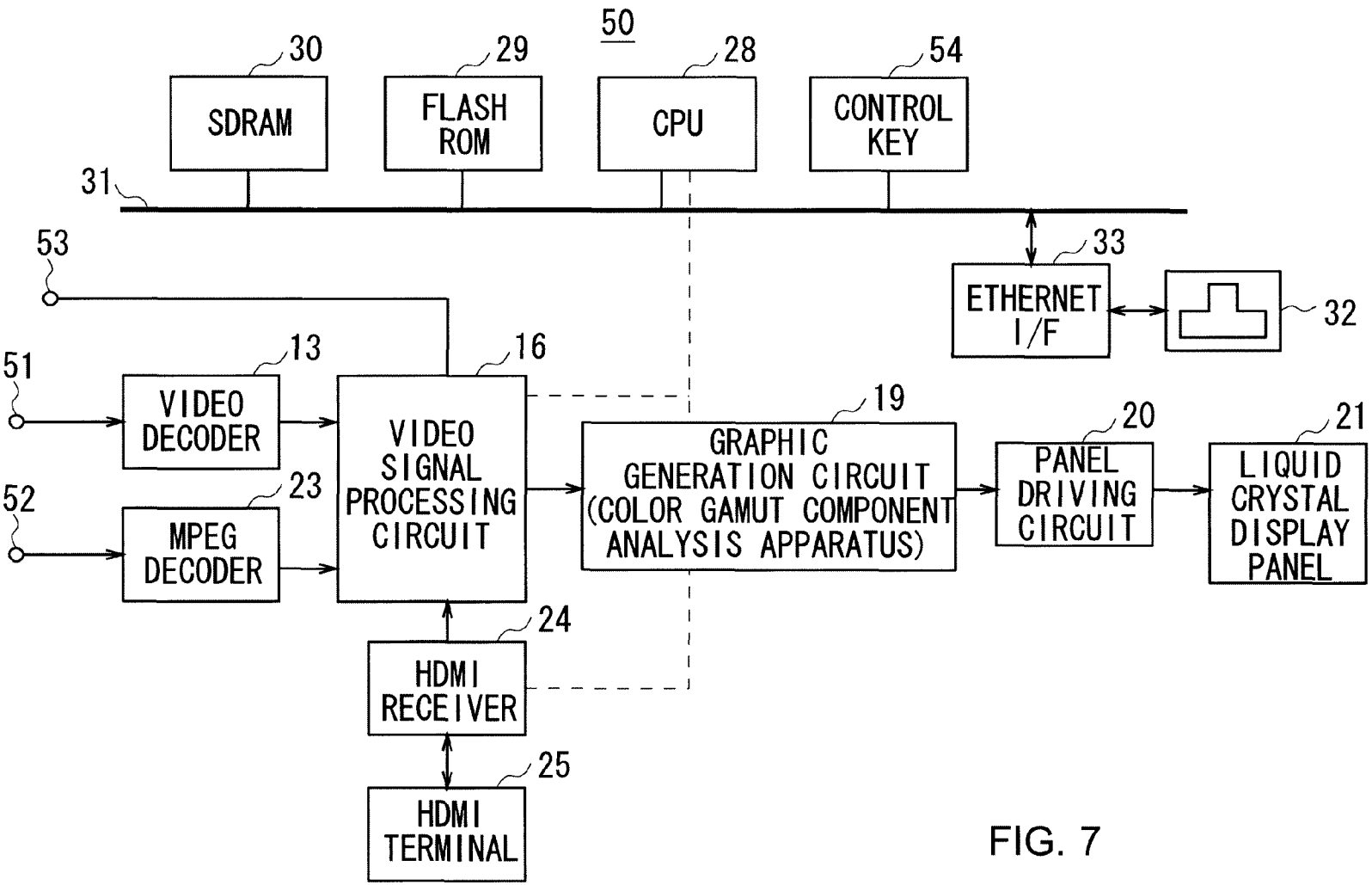
FIG. 7 is a schematic block diagram showing the circuit configuration of a handy type video camera.

On the other hand, referring to FIG. 7 in that the same reference numerals are added to corresponding parts to FIG. 6, the reference numeral 50 generally shows a handy type video camera mounting a graphic generation circuit 19 that corresponds to the color gamut component analysis apparatus 1. The CPU 28 integrally controls the whole apparatus, and executes predetermined processing by starting a basic program and various application programs (including a color gamut component analysis program) stored in a flash ROM 29 that is connected via an internal bus 31 in an SDRAM 30.

Practically, the handy type video camera 50 transmits a video signal supplied via an input terminal 51 to a video decoder 13. The video decoder 13 converts the video signal into a digital component signal composed of a luminance signal (Y) and a color difference signal (Cb, Cr), and transmits the digital component signal to a video signal processing circuit 16.

The video signal processing circuit 16 performs predetermined signal processing on the digital component signal, and then transmits the digital component signal to a graphic generation circuit 19.

The graphic generation circuit 19 corresponds to the aforementioned color gamut component analysis apparatus 1 (FIG. 2). The graphic generation circuit 19 transmits a graphic superimposed video signal PG1 obtained by superimposing a graphic processed image G1A, G2A or G3A in a color that was selected according to user's operation to a control key 54 on a reproducing image to a panel driving circuit 20.

The panel driving circuit 20 drives a liquid crystal display panel 21 according to the graphic superimposed video signal PG1 supplied from the graphic generation circuit 19, so that a graphic superimposed image based on the graphic superimposed video signal PG1 is displayed on the above liquid crystal display panel 21.

Further, the CPU 28 of the handy type video camera 50 transmits an MPEG-TS stream supplied via an input terminal 52 to an MPEG decoder 23. The MPEG decoder 23 decodes the MPEG-TS stream to convert it into a digital component signal, and transmits the digital component signal to the video signal processing circuit 16.

The video signal processing circuit 16 performs predetermined signal processing on the digital component signal, and then transmits the digital component signal to the graphic generation circuit 19. The graphic generation circuit 19 transmits a graphic superimposed video signal PG1 that was obtained by superimposing the graphic processed image G1A, G2A or G3A in the color that was selected according to user's operation to the control key 54 on the reproducing image to the panel driving circuit 20.

Further, the video signal processing circuit 16 also performs predetermined signal processing on a digital component signal supplied via an input terminal 53, and then transmits the digital component signal to the graphic generation circuit 19. The graphic generation circuit 19 transmits the graphic superimposed video signal PG1 that was obtained by superimposing the graphic processed image G1A, G2A or G3A in the color selected according to user's operation to the control key 54 on the reproducing image to the panel driving circuit 20.

The panel driving circuit 20 drives the liquid crystal display panel 21 according to the graphic superimposed video signal PG1 supplied from the graphic generation circuit 19, so that the graphic superimposed image based on the graphic superimposed video signal PG1 is displayed on the above liquid crystal display panel 21.

Note that, the CPU 28 of the handy type video camera 50 has an HDMI terminal 25. A digital component signal supplied from the outside via the above HDMI terminal 25 can be received by an HDMI receiver 24, and it can be taken in the video signal processing circuit 16.

Therefore, in the liquid crystal television 50, predetermined processing can be also performed on the digital component signal taken in from the outside via the HDMI terminal 25. The graphic processed image G1A, G2A or G3A is generated by the graphic generation circuit 19, and the graphic superimposed video signal PG1 is generated by superimposing it on the reproducing image. This can be displayed on the liquid crystal display panel 21 by the panel driving circuit 20 as a graphic superimposed image.

In this connection, the handy type video camera 50 can be externally connected to the Internet or the like via a network terminal 32 and an Ethernet (registered trademark) interface (I/F) 33. Predetermined processing can be performed also on a digital component signal taken in from the outside via the Internet. A graphic processed image G1A, G2A or G3A is generated by the graphic generation circuit 19, and it is superimposed on a reproducing image to generate a graphic superimposed video signal PG1. This can be displayed on the liquid crystal display panel 21 by the panel driving circuit 20 as a graphic superimposed image.

(5) Operation and Effect

According to the above configuration, the histogram processing circuit 4 in the color gamut component analysis apparatus 1 performs histogram processing based on a color difference signal (Cb, Cr), sets the total sum sRGBmax of a color gamut component amount in the sRGB standard as a threshold level, calculates a wide color gamut component amount WC above this threshold level according to the equation (1), and transmits the calculation result to the graphic processing circuit 5.

The graphic processing circuit 5 performs graphic processing for visually displaying the wide color gamut component amount WC above the total sum sRGBmax of the color gamut component amount in the sRGB standard as easy to understand, based on the calculation result supplied from the histogram processing circuit 4, to generate a graphed graphic processed image G1A, G1B or G1C, and transmits this to the graphic superimpose circuit 3.

The graphic superimpose circuit 3 generates a reproducing image based on a luminance signal (Y) supplied from the timing adjustment circuit 2, and the color difference signal (Cb, Cr), and generates a graphic superimposed video signal PG1 by superimposing the graphic processed image G1A, G2A or G3A supplied from the graphic processing circuit 5 on the reproducing image, and outputs this from the monitor in the latter stage as a graphic superimposed image.

Thereby, in the color gamut component analysis apparatus 1, as shown in FIG. 4, the graphic superimposed video image FG in that the graphic processed image G3A has been superimposed on the reproducing image can be displayed on the monitor. It can make the user who visually confirms the reproducing image of the above graphic superimposed image FG fixedly and immediately recognize that a green component such as a mountain and a forest in the reproducing image is represented by a quite deep color (green) by the xvYCC standard by the graphic processed image G3A.

That is, in the color gamut component analysis apparatus 1, in the case where the graphic processed image G3A of the graphic superimposed video image FG does not exist, whether or not a green component such as a mountain and a forest in the reproducing image is represented by a quite deep color (green) by the xvYCC standard cannot be recognized by the user who visually confirms the reproducing image of the graphic superimposed video image FG, and it sometimes made the user feel uneasy. However, by displaying the graphic superimposed video image FG on the monitor, such point is solved; and the presence of a color component by the xvYCC standard can be informed. It can give the user secure feeling.

According to the above configuration, in the color gamut component analysis apparatus 1, the graphic superimposed video image FG in that the graphic processed image G3A has been superimposed on the reproducing image is displayed on the monitor. It can make the user who visually confirms the reproducing image of the above graphic superimposed video image FG fixedly and immediately recognize the presence of a wide color gamut component amount by the xvYCC standard existing in the reproducing image and the ratio via the graphic processed image G3A.

(6) Other Embodiments

Figure 8:
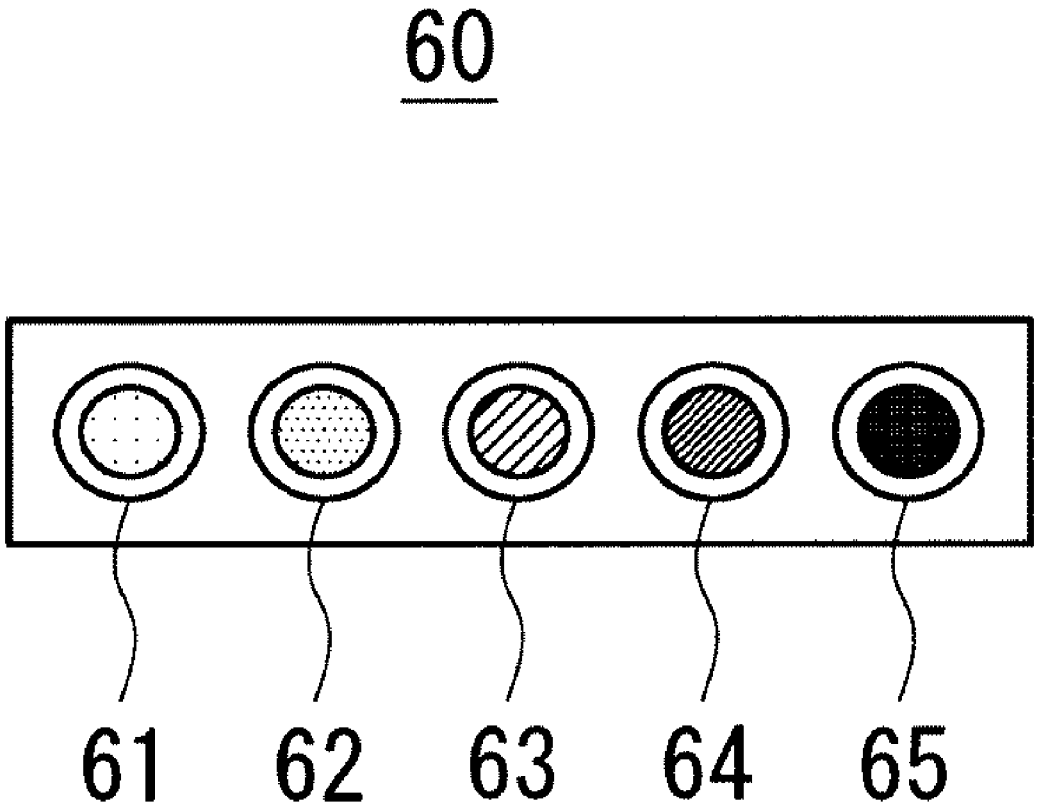
FIG. 8 is a schematic diagram showing an image by graphic processing representing a color component in other embodiment (1)

In the aforementioned embodiment, it has dealt with the case where a graphic processed image G1A, G2A or G3A shown in FIGS. 3A-3B is generated by the graphic processing circuit 5, and a graphic superimposed image that is obtained by superimposing it on a reproducing image is displayed, so that the presence of a wide color gamut component amount WC above the total sum sRGBmax of a color gamut component amount in the sRGB standard or the ratio is informed the user. However, the present invention is not only limited to this but also for example, a graphic image 60 in which a plurality of LEDs (Light Emitting Diodes) are arranged as shown in FIG. 8 may be provided. And if a wide color gamut component in the xvYCC standard above the maximum value sRGBmax of chromaticity in a video signal by the sRGB standard does not exist, LEDs from the left side to the center 61-63 are lighted. If the wide color gamut component amount WC above the total sum sRGBmax of a color gamut component amount in the sRGB standard exists, LEDs more right than the center 64 and 65 are lighted by matching to the amount. Thereby, the presence of the wide color gamut component amount WC by the xvYCC standard above the total sum sRGBmax of a color gamut component amount in the sRGB standard or the ratio may be informed the user.

Figure 9A:
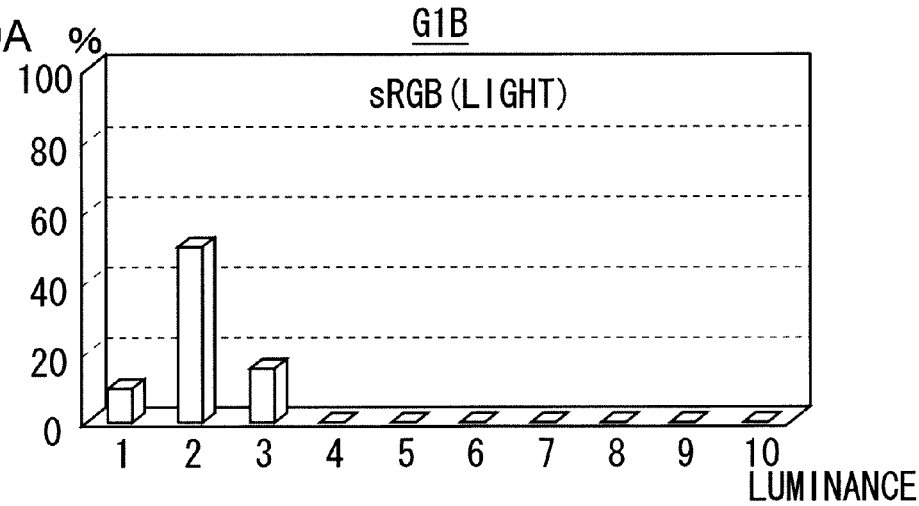
FIGS. 9A-9C are schematic diagrams showing an image by graphic processing representing a color component in other embodiment (2)
Figure 9B:
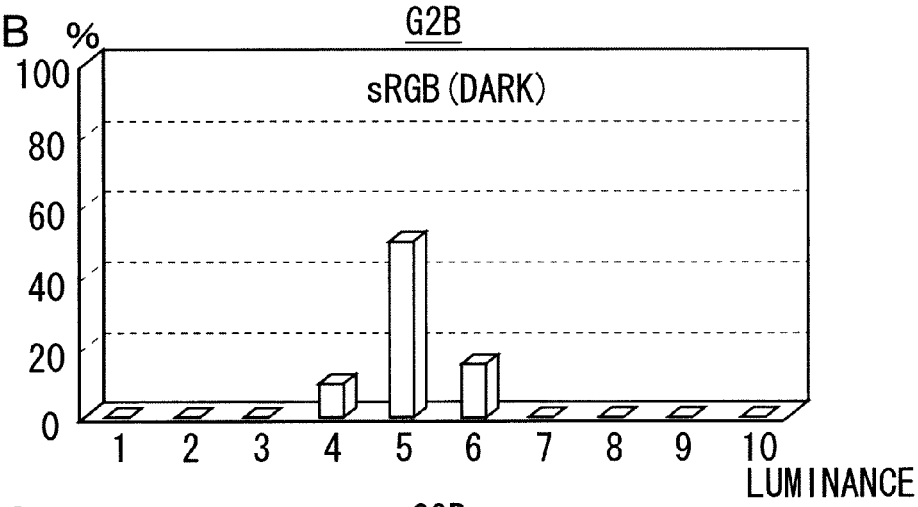
Figure 9C:
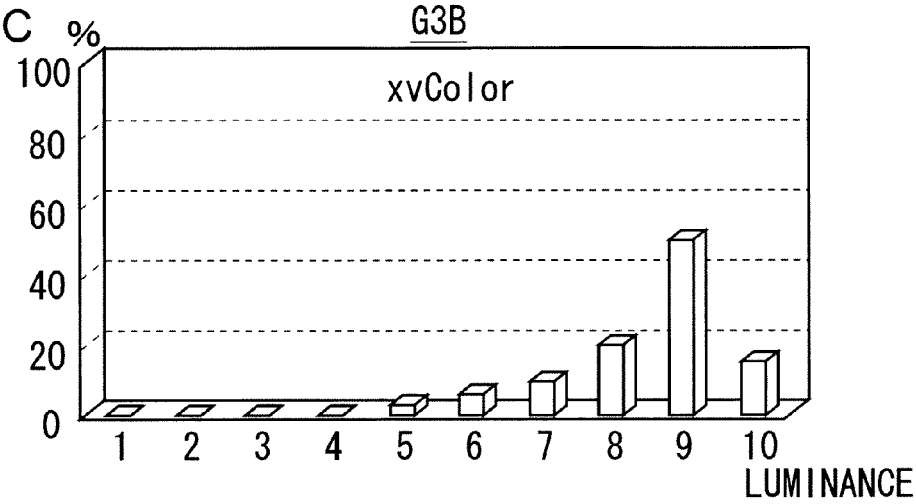

Further, in the aforementioned embodiment, it has dealt with the case where a graphic processed image G1A, G2A or G3A representing a threshold level corresponding to the total sum sRGBmax of a color gamut component amount in the sRGB standard shown in FIGS. 3A-3C is generated by the graphic processing circuit 5. However, the present invention is not only limited to this but also as shown in FIGS. 9A-9C, a graphic processed image G1B, G2B or G3B in which a threshold level corresponding to the total sum sRGBmax of the color gamut component amount in the sRGB standard does not exist may be generated.

In this case, in the case where even if the threshold level corresponding to the total sum sRGBmax of the color gamut component amount in the sRGB standard does not exist in the graphic processed image G1B, G2B or G3B, a pixel in that the luminance level is "7" or above exists, it is good to make the user recognize that a wide color gamut component by the xvYCC standard above the total sum sRGBmax of the color gamut component amount in the sRGB standard exists.

Figure 10:
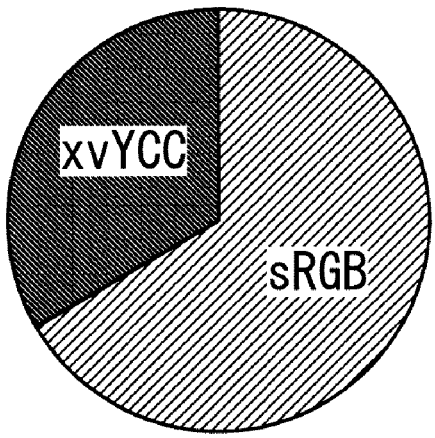
FIG. 10 is a schematic diagram showing an image by graphic processing representing a color component in other embodiment (3)

Further, in the aforementioned embodiment, it has dealt with the case where a graphic processed image G1A, G2A or G3A shown in FIGS. 3A-3C is generated by the graphic processing circuit 5. However, the present invention is not only limited to this but also as shown in FIG. 10, the presence of the wide color gamut component amount WC by the xvYCC standard and the ratio may be shown by a circle graph image G4.

Figure 11:
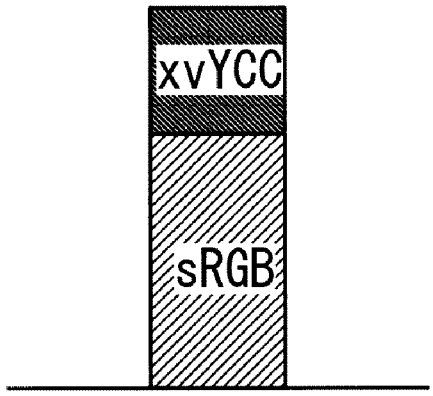
FIG. 11 is a schematic diagram showing an image by graphic processing representing a color component in other embodiment (4).

Further, in the aforementioned embodiment, it has dealt with the case where a graphic processed image G1A, G2A or G3A shown in FIGS. 3A-3C is generated by the graphic processing circuit 5. However, the present invention is not only limited to this but also as shown in FIG. 11, the presence of the wide color gamut component amount WC by the xvYCC standard and the ratio may be shown by a bar graph image G5.

Further, in the aforementioned embodiment, it has dealt with the case where the graphic generation circuit 19 (the color gamut component analysis apparatus 1) executes the processing procedure for displaying a color component of the aforementioned routine RT1, according to the color gamut component analysis program previously stored in the flash ROM 29. However, the present invention is not only limited to this but also the aforementioned processing procedure for displaying a color component may be executed according to a color gamut component analysis program installed from a recording medium, a color gamut component analysis program downloaded from the Internet, and a color gamut component analysis program installed by other various routes.

Further, in the aforementioned embodiment, it has dealt with the case where the color gamut component analysis apparatus 1 serving as a color gamut component analysis apparatus, and the graphic generation circuit 19 are formed by the histogram processing circuit 4 serving as histogram processing means, and color gamut component calculating means and the graphic processing circuit serving as graphic processing means. However, the present invention is not only limited to this but also a color gamut component analysis apparatus may be formed by histogram processing means, color gamut component calculating means and graphic processing means having other various circuit configurations.

A color gamut component analysis apparatus, a method of analyzing color gamut components, and a color gamut component analysis program according to the present invention are applicable to a cellular phone that can record a moving image, a cellular phone that can receive television broadcasting, for example.

It should be understood by those skilled in the art that various modifications, combinations, sub-combinations and alterations may occur depending on design requirements and other factors insofar as they are within the scope of the appended claims or the equivalents thereof.

What is claimed is:

1. A color gamut component analysis apparatus comprising:

histogram processing means for performing histogram processing on color components in a video signal;

color gamut component calculating means for calculating a wide color gamut component amount of the video signal that is above a threshold amount equal to a total sum of a color gamut component amount of a signal formatted according to a predetermined standard, based on a result of the histogram processing by said histogram processing means, said signal formatted according to the predetermined standard having an image color space smaller than a format of the video signal; and graphic processing means for generating and outputting a user interface image that shows an amount by which said wide color gamut component amount in said video signal is above the threshold amount.

2. The color gamut component analysis apparatus according to claim 1, wherein said graphic processing means generates and outputs said user interface image as a circle graph.

3. The color gamut component analysis apparatus according to claim 1, wherein said graphic processing means generates and outputs said user interface image as a numerical value.

4. The color gamut component analysis apparatus according to claim 1, wherein said graphic processing means displays said user interface image as superimposed on an output image.

5. The color gamut component analysis apparatus according to claim 4, wherein the output image is from a television signal.

6. The color gamut component analysis apparatus according to claim 1, wherein the predetermined standard is sRGB standard, the video signal is xvYCC standard, and the color gamut component amount of the video signal is WC and the total sum of the color gamut component amount of the signal formatted according to the predetermined standard is sRGB-max, and the color gamut component calculating means determines the WC according to WC(%)={(MAX-sRGB-max)/MAX}×100, the MAX being a total sum of the color gamut component amount in the xvYCC standard.

7. The color gamut component analysis apparatus according to claim 1, wherein the video signal is a television signal.

8. A television comprising:

a video receiving device;

a display device; and the color gamut component analysis apparatus according to claim 1.

9. A method of analyzing a color gamut component comprising:

performing, with a color gamut component analysis apparatus, histogram processing on color components in a video signal;

calculating, with the color gamut component analysis apparatus, a wide color gamut component amount of the video signal that is above a threshold amount equal to a total sum of a color gamut component amount of a signal formatted according to a predetermined standard based on a result of the histogram processing, said signal formatted according to the predetermined standard having an image color space smaller than a format of the video signal; and generating and outputting, with the color gamut component analysis apparatus a user interface image that shows an amount by which said wide color gamut component amount in said video signal is above the threshold amount.

10. A non-transitory computer readable medium having computer readable instructions recorded thereon, the instructions configured to perform a color gamut component analysis method when executed on an information processing apparatus, the method comprising:

performing histogram processing on color components in a video signal;

calculating a wide color gamut component amount of the video signal that is above a threshold amount equal to a total sum of a color gamut component amount of a signal formatted according to a predetermined standard based on a result of the histogram processing, said signal formatted according to the predetermined standard having an image color space smaller than a format of the video signal; and generating and outputting a user interface image that shows an amount by which said wide color gamut component amount in said video signal is above the threshold amount.

11. A color gamut component analysis apparatus comprising:

a memory that stores computer executable instructions;

a hardware processor; and a display device, wherein the hardware processor is configured by the executable instructions to perform histogram processing on color components in a video signal, calculate a wide color gamut component amount of the video signal that is above a threshold amount equal to a total sum of a color gamut component amount of a signal formatted according to a predetermined standard based on a result of the histogram processing, said signal formatted according to the predetermined standard having an image color space smaller than a format of the video signal, and generate arid output a user interface image that shows an amount by which said wide color gamut component amount in said video signal is above the threshold amount.

* * * * *